US006832701B2

(12) United States Patent
Schiller

(10) Patent No.: US 6,832,701 B2
(45) Date of Patent: Dec. 21, 2004

(54) SELF METERING DISPENSING DEVICE

(75) Inventor: Steven E. Schiller, Kenosha, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 40 days.

(21) Appl. No.: 10/117,405

(22) Filed: Apr. 5, 2002

(65) Prior Publication Data

US 2003/0189066 A1 Oct. 9, 2003

(51) Int. Cl.[7] ..... B67D 5/06
(52) U.S. Cl. ..... 222/181.3; 222/402.15
(58) Field of Search ..... 222/181.3, 402.15, 222/477, 649

(56) References Cited

U.S. PATENT DOCUMENTS

| | | | | |
|---|---|---|---|---|
| 772,874 A | | 10/1904 | Donaldson | 251/48 |
| 3,007,613 A | | 11/1961 | Tygard | 222/394 |
| 4,360,130 A | | 11/1982 | Nishimura et al. | 222/153 |
| 5,016,790 A | | 5/1991 | Thomas et al. | 222/639 |
| 5,799,826 A | * | 9/1998 | Brown et al. | 222/4 |
| 5,908,143 A | | 6/1999 | Crossdale et al. | 222/52 |
| 6,029,862 A | | 2/2000 | Jones | 222/402 |
| 6,267,274 B1 | | 7/2001 | Smrt | 222/646 |
| 6,540,110 B2 | * | 4/2003 | Weiser | 222/103 |

FOREIGN PATENT DOCUMENTS

| | | | |
|---|---|---|---|
| DE | 299 19 080 U1 | 2/2000 | B05B/9/04 |
| EP | 0 275 836 A1 | 7/1988 | A47K/5/12 |

* cited by examiner

*Primary Examiner*—Gene Mancene
*Assistant Examiner*—Patrick Buechner
(74) *Attorney, Agent, or Firm*—Warren R. Bovee; Neil E. Hamilton; Renee J. Rymarz

(57) ABSTRACT

A self metering dispensing device for dispensing a predetermined quantity of material from an aerosol container. First and second actuating members are pivotally connected to a housing for the container and a nozzle actuating member is connected to the first actuating member. A pneumatic member in the form of a cylinder with a piston or a telescoping valve is operatively associated with the first and second actuating members. A compressive force placed on the second actuating member causes the nozzle activating member to contact the container valve to dispense product from the container. A controlled metering of product is produced by an air regulator connected to the pneumatic member.

21 Claims, 17 Drawing Sheets

SELF METERING DISPENSING DEVICE

BACKGROUND OF THE INVENTION

1. Technical Field

This invention relates to a device for dispensing a fluid product from a valved container. More particularly, the invention relates to a self metering dispensing device for dispensing a predetermined quantity of fluid material from an aerosol container.

2. Background Art

There is a problem controlling the dispensing fluid materials from an aerosol container with a valve-actuated nozzle. As long as the valve-actuated nozzle is contacted, product is dispensed from the container. This can result in a waste of product.

In U.S. Pat. Nos. 3,007,613 and 6,029,862 there are described valve actuator devices for aerosol containers that employ trigger mechanisms. These devices do not lend themselves to ease of operation. Neither do they provide a means to readily adjust the devices for delivery of predetermined quantities of material from the aerosol containers.

Many soap dispensers are actuated by hand pressing a bar. This affords fast and ease of operation. Many hand operated soap dispensers are of the pump type where a hand-operated lever causes a force to be acted on a flexible tube to dispense the soap. The amount of dispensed soap is easier to control than with soap which is dispensed from an aerosol container where only a slight movement of a valve actuated nozzle can dispense an uncontrolled amount of soap product.

The objects of the invention therefore are:

a. Providing on improved dispensing device for aerosol containers.

b. Providing a dispensing device of the foregoing type that affords ease of operation.

c. Providing a dispensing device of the foregoing type that is self metering.

d. Providing a dispensing device of the foregoing type that is readily adjustable.

e. Providing a dispensing device of the foregoing type that can accommodate an aerosol container.

These and still other objects and advantages of the invention will be apparent from the description that follows. In the detailed description below preferred embodiments of the invention will be described in reference to the full scope of the invention. Rather, the invention may be employed in other embodiments.

SUMMARY OF THE INVENTION

The foregoing objects are accomplished and the shortcomings of the prior art are overcome by the self metering dispensing device for dispensing a predetermined quantity of material from a container. The device of this invention includes a housing defining a support for the container and first and second actuating members pivotally connected to the housing. A nozzle activating member is connected to the first actuating member. A fluid cylinder member has a reciprocating piston therein and a fluid regulator. A reciprocating rod is operatively connected to the piston and the cylinder member and the rod are operatively associated with the first and second actuating members. A first and second biasing member are connected to the housing and the respective first and second actuating members.

In a preferred embodiment there are two fluid cylinder members and rods with both cylinder members and the rods operatively associated with the first and second actuating members.

In another preferred embodiment the cylinder member is connected to the first actuating member and the rod is connected to the second actuating member.

In still another preferred embodiment, a telescoping valve is employed in place of the fluid cylinder member with the piston and rod.

In one aspect the housing is constructed and arranged to support the container in an inverted position with the housing constructed in two sections and the first and second actuating members connected to one of the two sections and the container is supported by the other section.

In another aspect the second actuating member includes a hand pressable plate with the hand pressable plate being pivotally connected to the housing by two oppositely disposed arm members.

BRIEF DESCRIPTION OF THE DRAWINGS

Referring to FIGS. 1–5, the dispensing device generally 10 includes two arm members 14 and 16, pivotally attached to housing 12 by means of screws 15. Bar member 18 is connected to and extends between arm members 14 and 16. A second bar member 22 is secured to the arm members 14 and 16 by the screws 24. Two cylinders 28 are mounted laterally of the housing 12 and are connected to bar member 31 as well as valve activating member 36. The attachment of cylinders 28 to bar member 31 is made by means of the nuts 38. The rods 32 of the pistons are in turn connected to the sides of arms 14 and 16 by means of the brackets 33 and the nuts 34 and 35.

Piston cylinders 28 are available from Dayton Electric Manufacturing Company in Niles, Ill. under the trademark Speedaire. Referring to FIG. 2, they include the usual piston 40. They also include an air opening 45 as well as an adjustable air regulator 42. Air regulator 42 includes a restrictive passage and a check valve in a passage parallel with the restrictive passage. As piston 40 moves in the directions of the air regulator 42, air is forced through the restrictive passage and against the check valve that is in a closed position. As the piston 40 moves away from the air regulator 42, air is free to pass around the restrictive passage and through the check valve at a faster rate. The size of the restrictive passage determines airflow and rate of movement of piston 40. To adjust the rate of movement of piston 40, different regulators with different sized passages would be substituted.

Referring to FIG. 6, the mounting of the activating member 36, as well as its biasing, is illustrated. There are two pivotal arms 37 (one of which is shown), which are connected inside of the housing 12. They are formed in a one piece fabrication with valve activating member 36. Biasing of the valve activating member 36 is effected by the springs 39 mounted on the mounting member 41 connected to activating member 36 at one end and on the mounting member 43 provided inside housing 12. It will be appreciated that there are two additional mounting members (not shown) to provide a mounting of an additional spring (not shown), positioned parallel to spring 34 to provide springs adjacent to the two arms 37. In a similar matter, and referring to FIG. 4, bar member 18 is biased from the housing 12 by the springs 44 positioned between the mounting screws 46 on the bar members 18 and mounting members 48 extending from the housing 12. Referring back to FIG. 6, an insert 37 connects the valve activating member 36 to bar member 31. The valve activating member 36 includes the nozzle contact portion 50 with the slot 52 to accommodate the nozzle 60 on the aerosol container 56 containing a soap material. Sloped or cammed surfaces 54 on the sides of the slot 52 engage the valve 62 in order to activate it and dispense product from the nozzle 60. The sloped surfaces 54 incrementally engage the valve 62 as the nozzle activating member 36 is moved inwardly toward the bottom of the container, as will be later explained in the Operation.

Referring to FIGS. 10 and 11, there is shown an alternative embodiment, generally 10A. There, instead of the cylinder 28 being connected to the bar member 31 and the valve activating member 36, it is instead connected to the arm member 18. The piston rod 32 is in turn connected directly to the nozzle activating member 36 rather than the bar member 18 and the arm members 14 and 16.

Referring to FIGS. 6–8 and in order to provide access to the container 56, the housing 12 is formed in two portions. There is the front portion 65 and the back portion 66. The back portion includes support 58 upon which rests the container 56 as well as the cover 59, which accommodates an upper portion of the container 56. The front portion 65 accommodates the actuation elements for valve 62 such as the attachment for the valve actuating member 36 and the connection of the arm members 14, 16 and 37.

In FIGS. 12–17, there is illustrated still another embodiment 10B. In place of the cylinder 28 and their associated rods 32 and pistons 40, there is a fluid compressible and self-expandable member in the form of a telescoping valve 80 positioned between bar members 18 and 31 with the check valve restrictor 42 connected to the valve 80. As seen in FIG. 17, the telescoping valve 80 includes an outer cup member 82 connected to bar member 31 which slides over an inner cup member 84 connected to bar member 18. A spring 86 biases the cup members 82 and 84 apart. The check valve restrictor 42 functions in the same manner as air regulator 42 with cylinders 28 in that when the valve 80 is compressed, air is forced through a restricted passage. A check valve is connected parallel to the flow of air through the restricted passage. When the valve is left to expand back to its original state, air can flow through the check valve.

Operation

Figure 7:
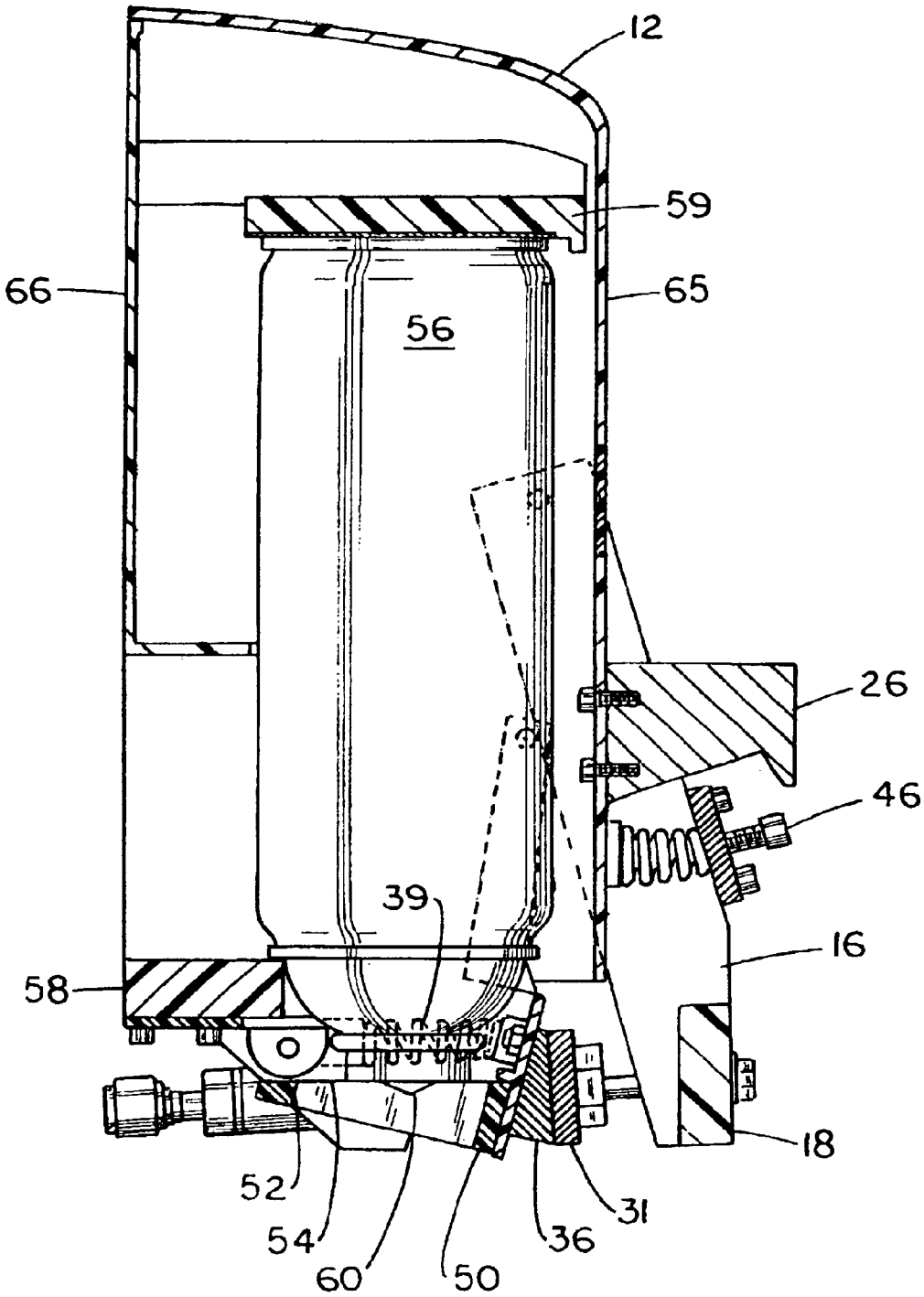
FIG. 7 is a view similar to FIG. 6 showing a second mode of operation.
Figure 8:
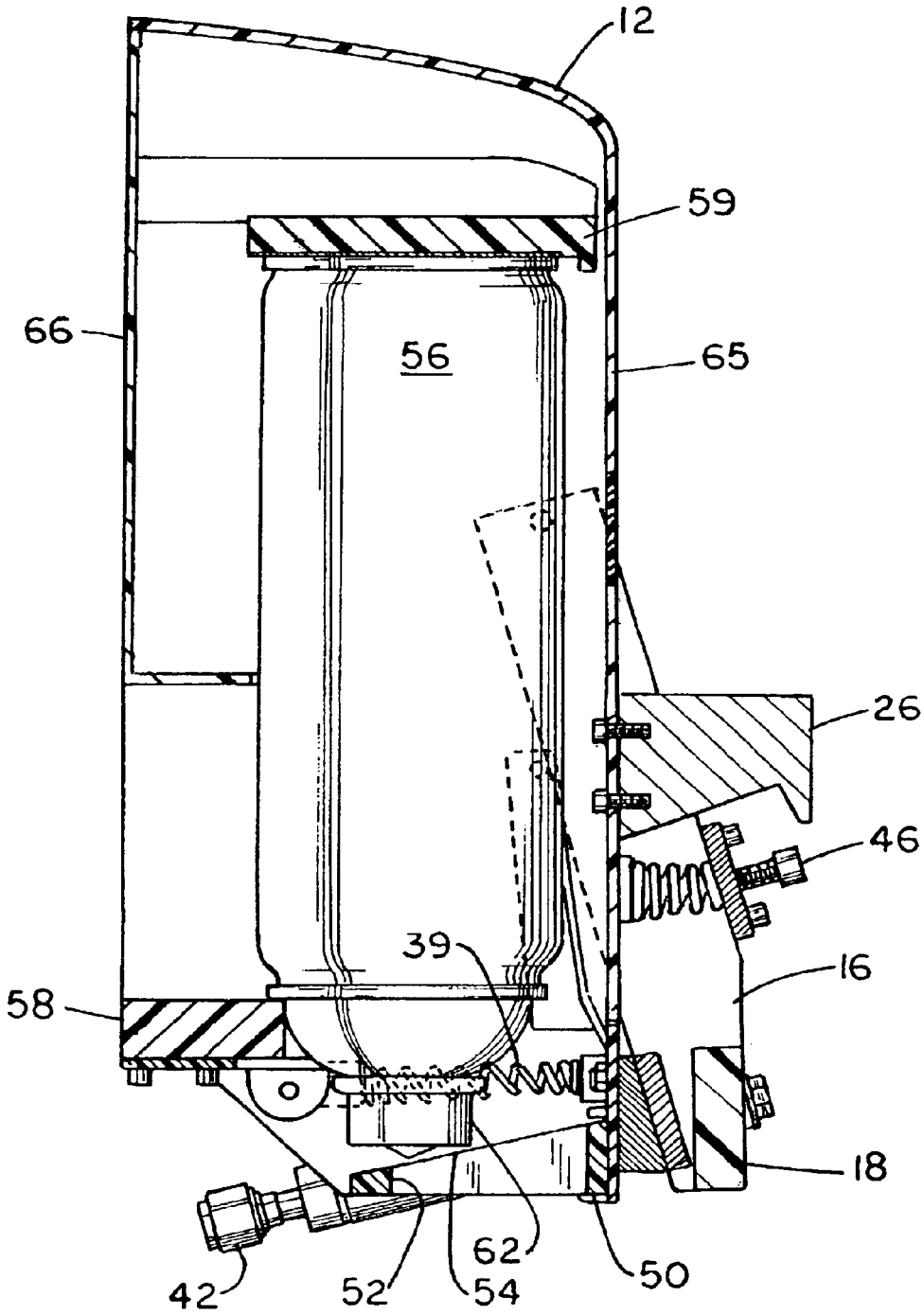
FIG. 8 is a view similar to FIG. 6 showing a third mode of operation.

A better understanding of the embodiments of this invention will be had by a description of their operation. Referring to the embodiment shown in FIGS. 1–8, FIG. 6 shows the embodiment in the static state with the bar member 18 and the nozzle activating member 36 in the position shown in this Figure. There it will be seen that the sloped surfaces 54 of the contact portion 50 of valve activating member 36 are not in contact with the valve 62. To activate this system, bar member 18 is depressed inwardly toward the housing 12. This causes the piston rods 32 to move inwardly into the cylinders 28 as well as the piston 40. As there is resistance to the movement of piston 40 by means of the air regulator 42, this causes movement of cylinders 28, bar member 31 and the valve activating member 36. This causes the sloped surfaces 54 of contact portion 50 to engage the valve 62 as seen in FIG. 7. This inward movement continues until the screw 46 engages the mounting member 48. It will be appreciated that as the activating member 36 is biased against the spring 39 that a force is effected against the activating member 36 to move it in the opposite direction and toward the bar member 18. This biasing force of springs 39 can move the activating member 36 and the cylinder 28 back over the piston rod 32 even with the bar member 18 its most inward position. This causes activating member 36 and contact portion 50 to move towards the bar member 18 and away from the valve member 62 as illustrated in FIG. 8. Thus even with bar member 18 in its most inward position, valve member 62 is no longer actuated and a metered amount of soap is dispensed. This metering is controlled by the air regulator 42 when the bar member 18 is initially moved in the direction of housing 12. This determines the time the contact portion 50 of nozzle actuating member 36 is in contact with valve 62. Bar member 18 will return to its static position when a force is released on bar member 18 through the biasing of springs 44. Outward movement is restricted by stop 26.

Figure 10:
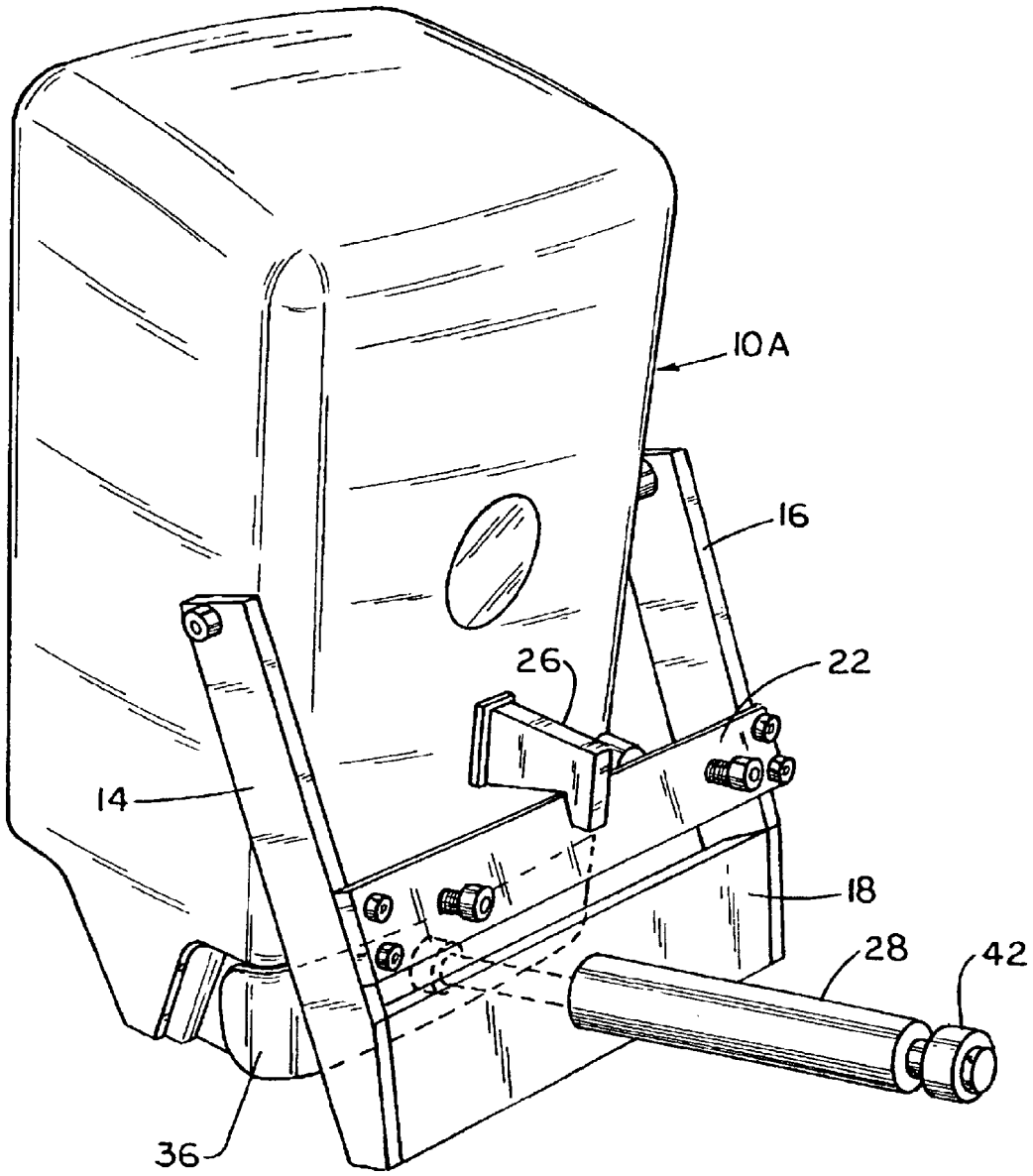
FIG. 10 is a perspective view 1 showing an alternative embodiment.
Figure 11:
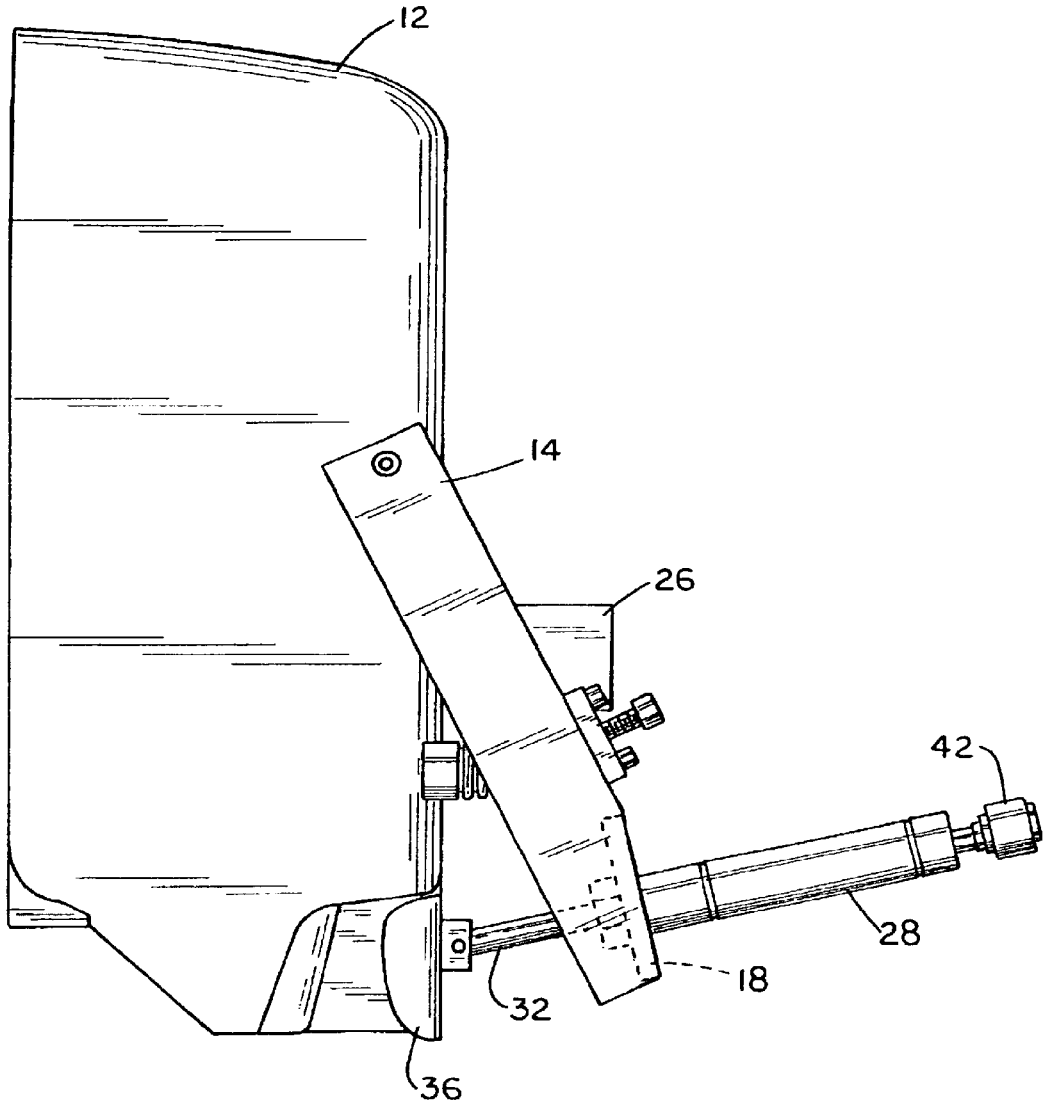
FIG. 11 is a side view showing the alternative embodiment of FIG. 10.

The operation of the embodiment 10A shown in FIGS. 10 and 11 is essentially the same, even though the position of cylinder 28 and the piston rod 32 are reversed with respect to connection to arm member 18 and the nozzle activating member 36. The inward movement of the arm member 18 would be controlled by the resistance of the air in the cylinder member 28 as the piston, such as 40, will cause inward movement of the nozzle actuating member 36 as previously described in conjunction with the description in FIGS. 6–8. The retraction of the nozzle activating member 36, even when bar member is in its most inward position, will be as previously described and the time of activation regulated by the air regulator 42. In this instance, both the inward movement of arm member 18 and the retraction of the nozzle actuating member 36 is regulated by the air regulator 42.

Figure 9:
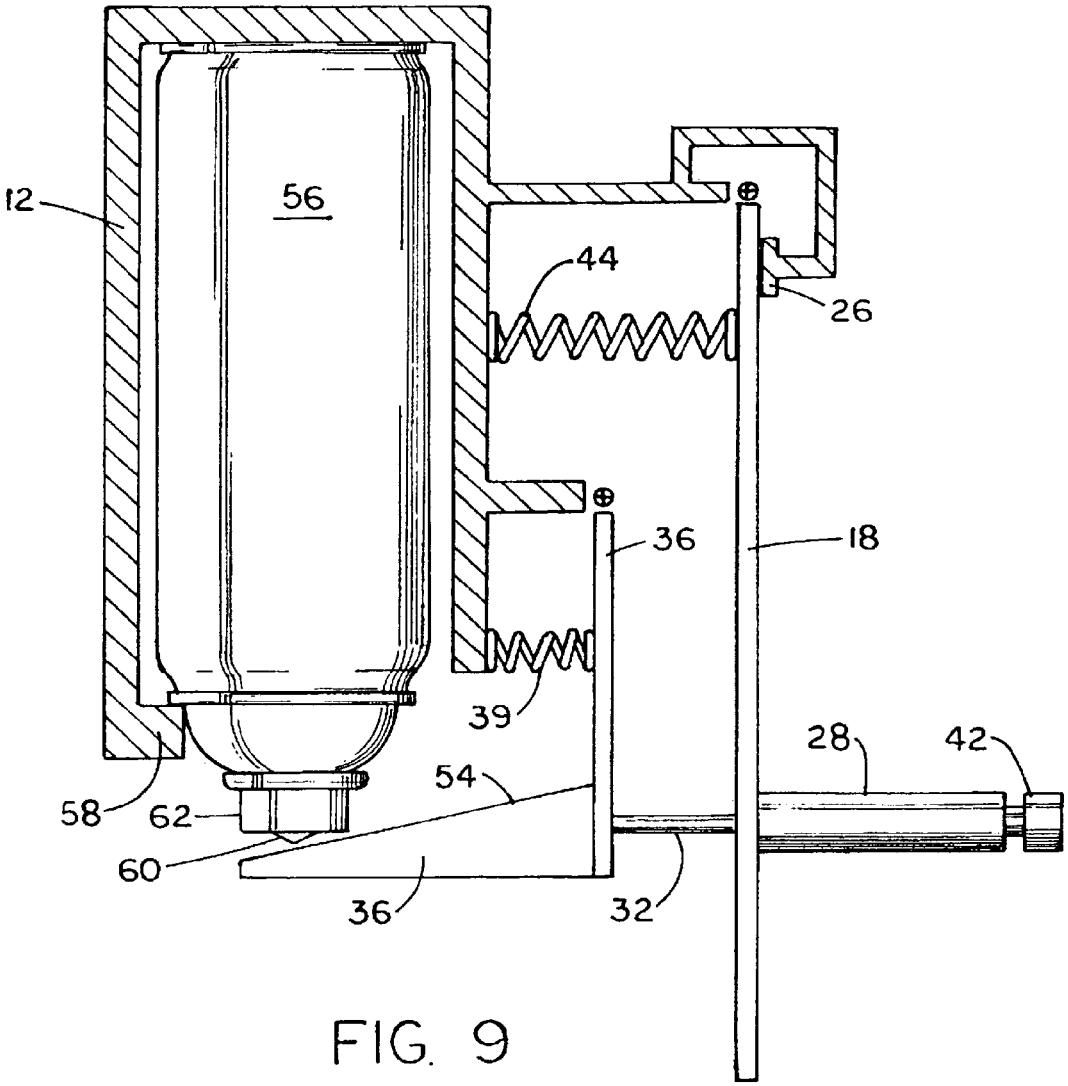
FIG. 9 is a diagrammatic view showing the operation of the operation of the dispensing device.

Referring to FIG. 9, the basic principle of interaction between valve activating member 36 and bar member 18 is illustrated. As bar member 18 is moved in the direction of the housing 12, the resistance of the air in the piston inside the cylinder 28 will cause the rod to move against the valve activating member 36. This causes sloped surfaces 54 to move against the valve 62. After arm member 28 has moved inwardly a predetermined distance, the nozzle activating member 36 is still able to move in the opposite direction by means of the spring 39 biasing the valve activating member 36 in the opposite direction and forcing the rod 32 back into the cylinder 28. The bar member 18 is returned to its original position with a release of force thereon by the spring 44 while the bar member 18 engages the stop 26.

Figure 12:
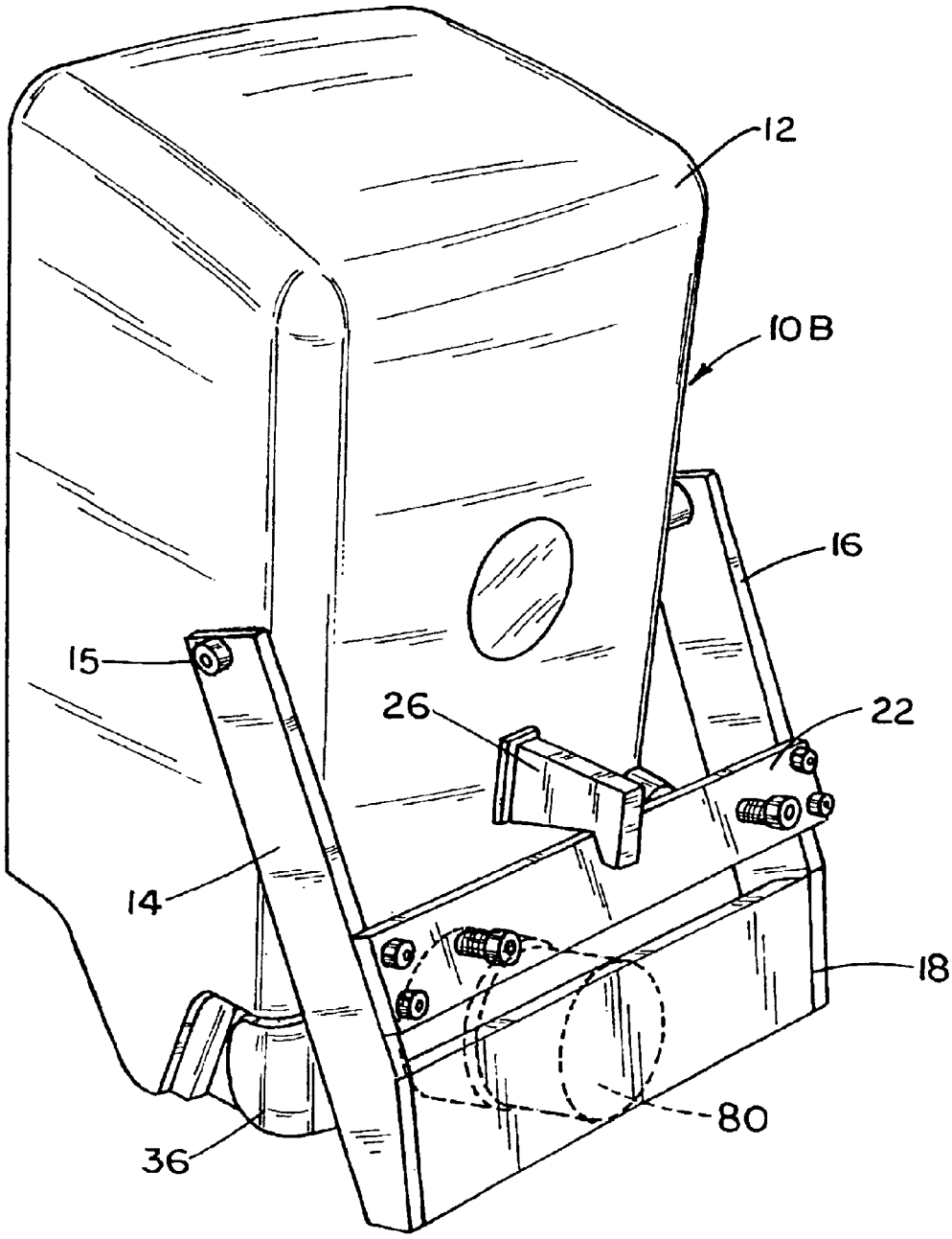
FIG. 12 is a view similar to FIG. 1 showing another embodiment.
Figure 13:
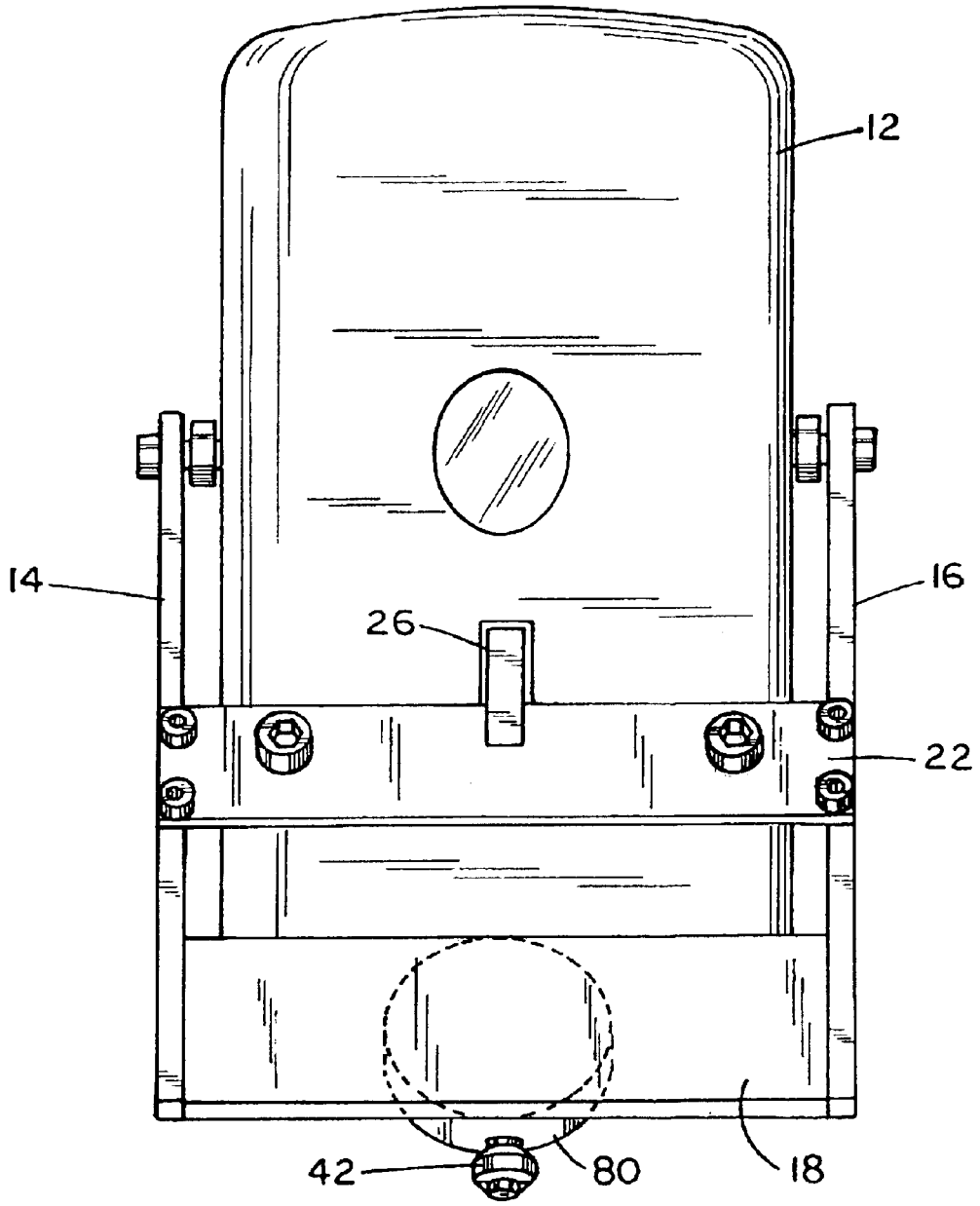
FIG. 13 is a front view of the FIG. 12 embodiment.
Figure 14:
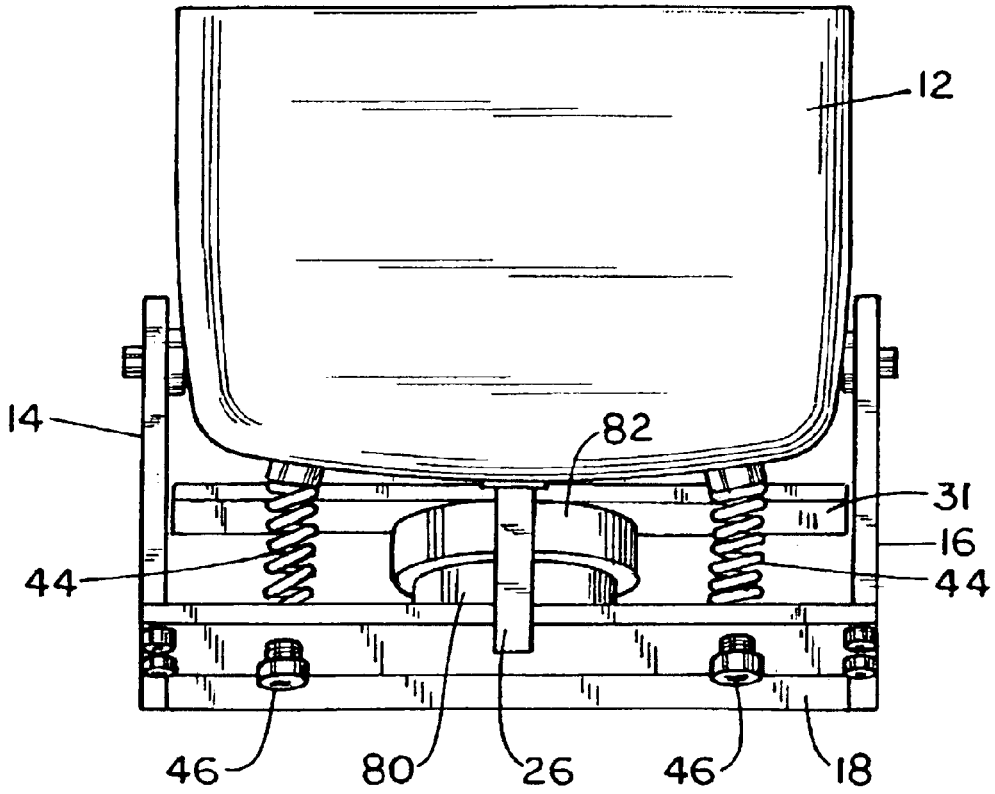
FIG. 14 is a top view of the FIG. 12 embodiment.
Figure 15:
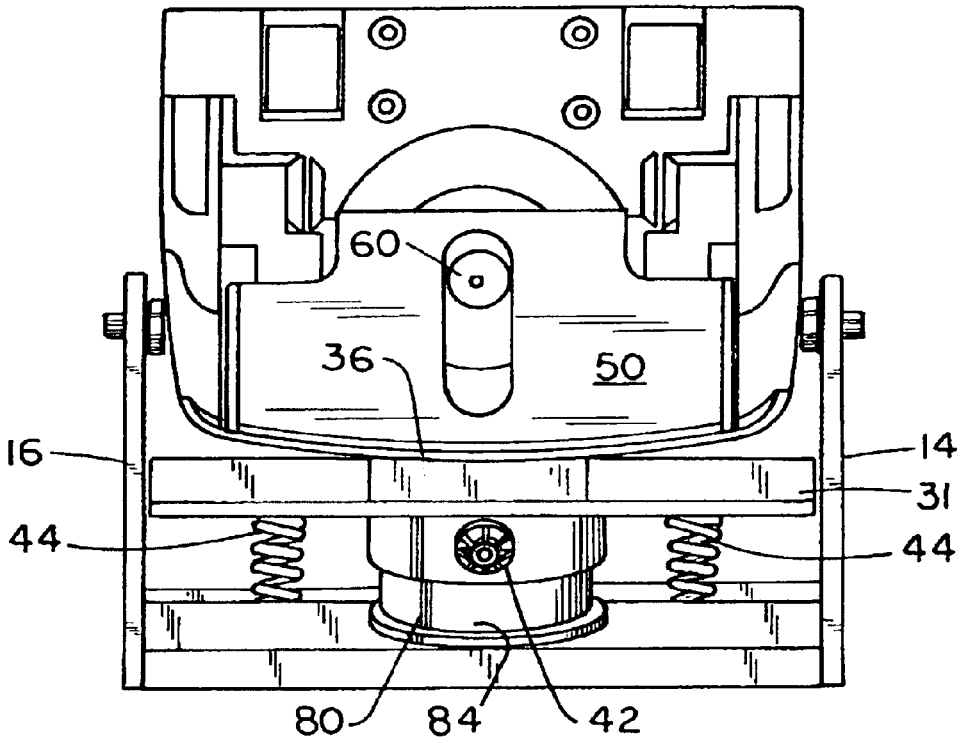
FIG. 15 is a bottom view of the FIG. 12 embodiment.
Figure 16:
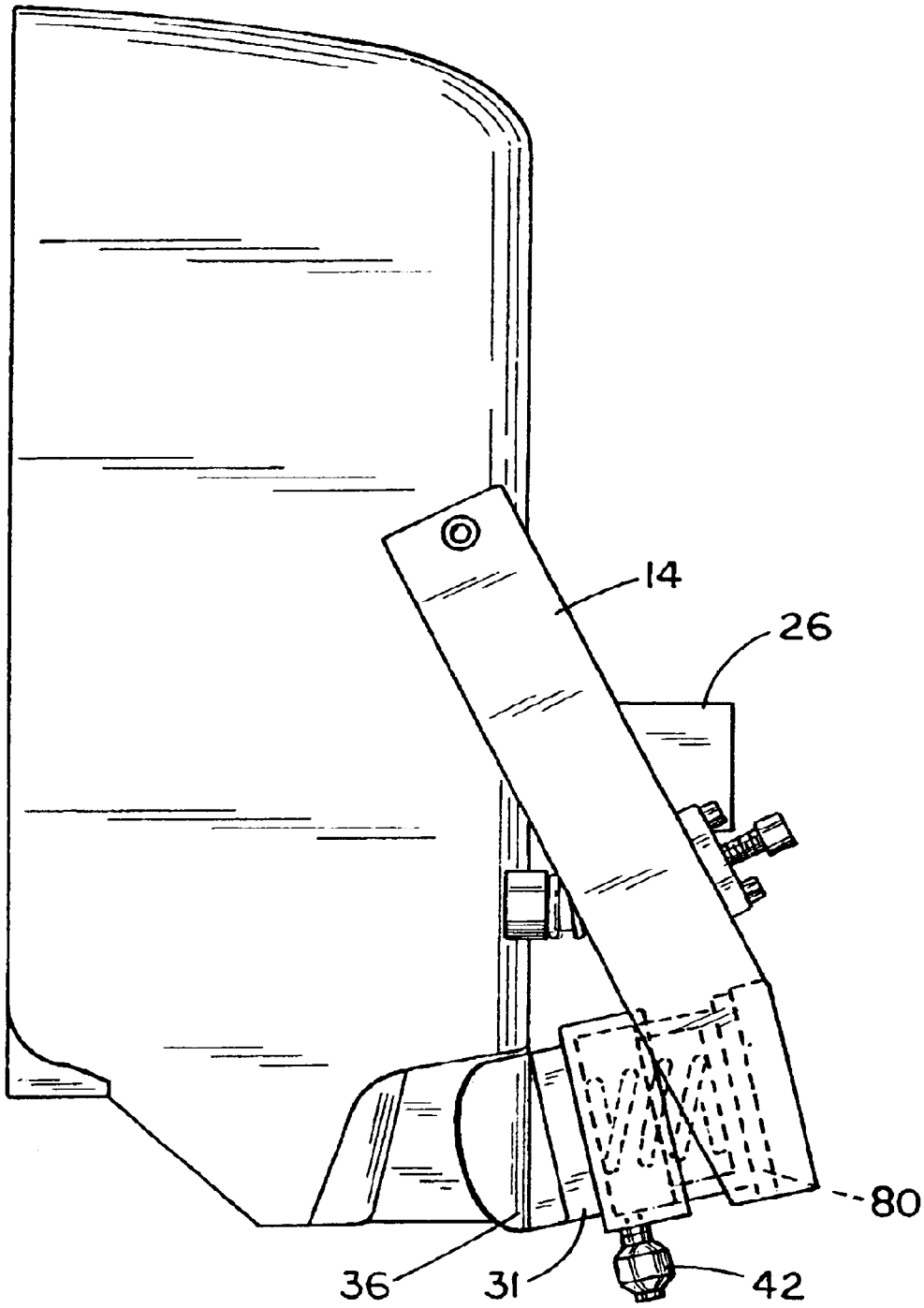
FIG. 16 is a side view of the FIG. 12 embodiment.
Figure 17:
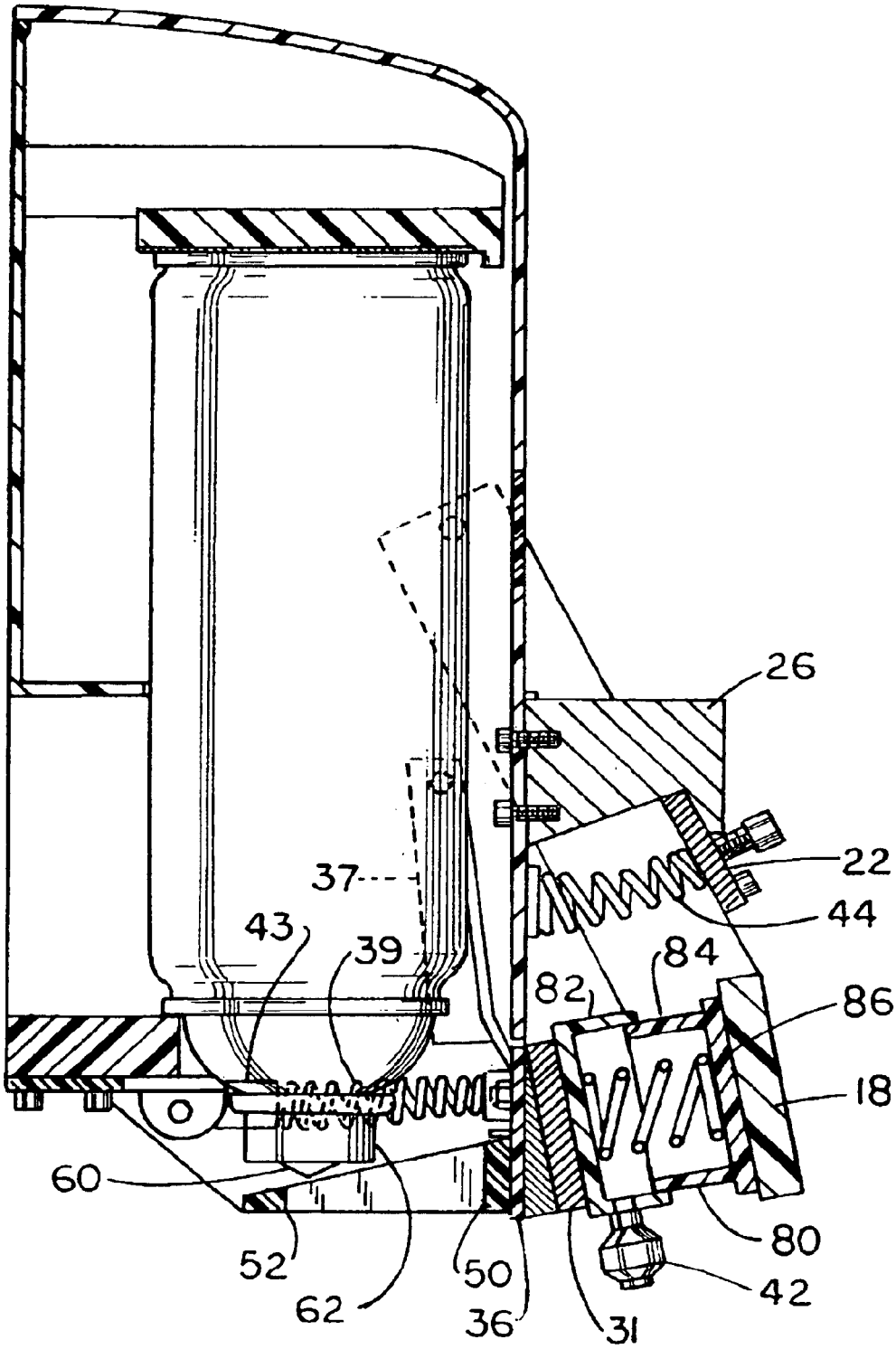
FIG. 17 is a view in vertical section of the FIG. 12 embodiment.

The operation of the embodiment 10B shown in FIG. 12 is essentially the same as that described in the previously referred to embodiments. As arm member 18 is moved in the direction of housing 12, this causes cup member 84 to slide into cup member 82 and spring 86 to partially collapse. The resistance of air being compressed between cup members 82 and 84 as regulated by air regulator 42 effects a force on valve actuating member 36 and contact portion 50 to open valve 62 as previously described and dispense product. This is shown in FIG. 17. The rate of compression is controlled by air regulator 42 which also controls the time actuating member and contact portion 50 contacts valve 62. At the same time, spring 39 acting on valve activating member 36 with be compressed. With bar member 18 in its most inwardly position, spring 39 will exert an opposing force on nozzle actuating 36 as well as bar member 31 and consequently cause cup member 82 to move back over cup member 84 in the direction of bar member 18 to move contact portion 50 in a direction away from valve 62 to close it. It will be seen that air regulator 42 controls the amount of air exiting the valve 80. This regulates the amount of contact by contact portion 50 with valve 62 both during compression of valve 80, and thus the amount of product dispensed. Bar member 18 will return to its static condition by a release of force on it and by means of spring 44 acting on bar member 22.

Figure 1:
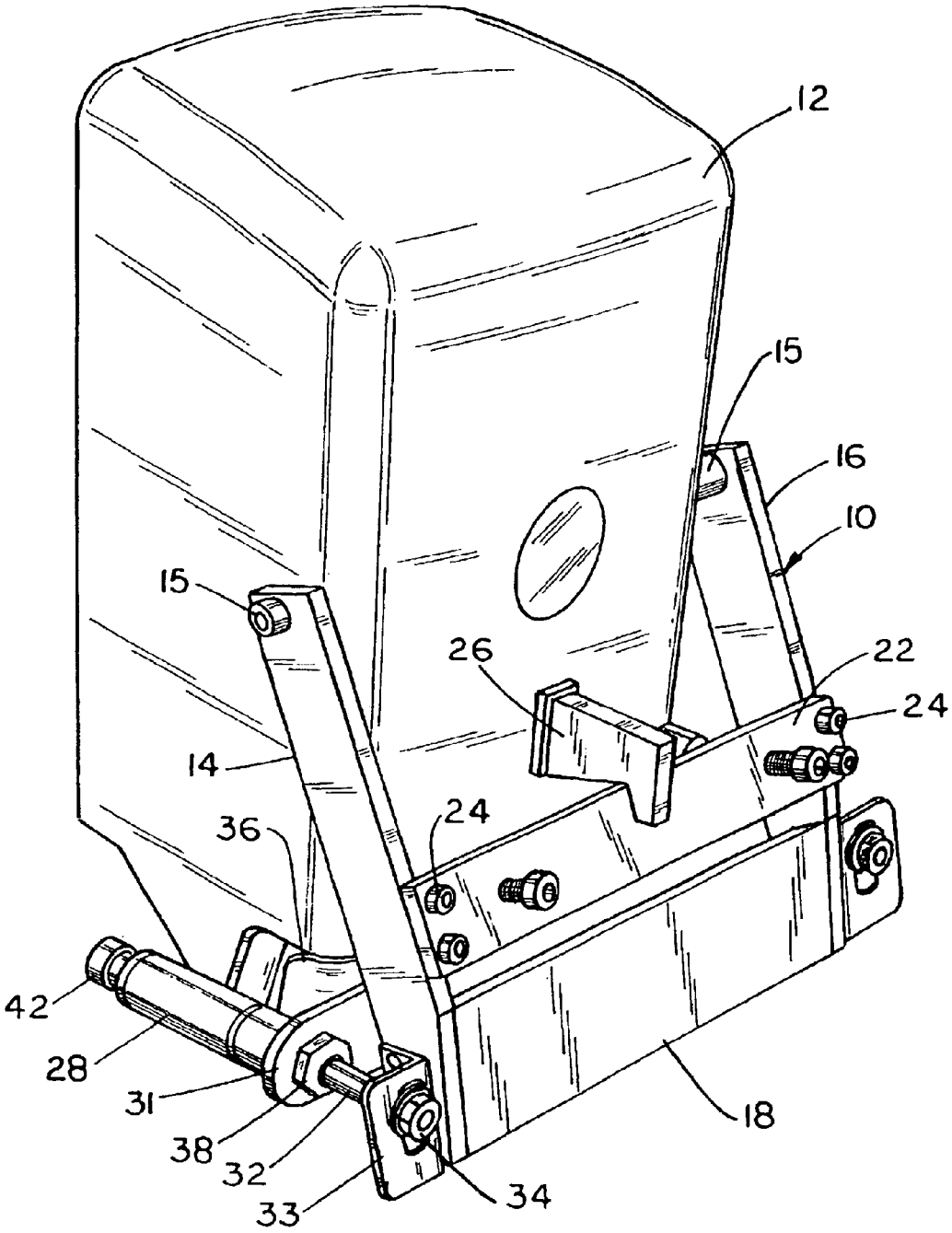
FIG. 1 is a perspective view of the self metering dispensing device.
Figure 2:
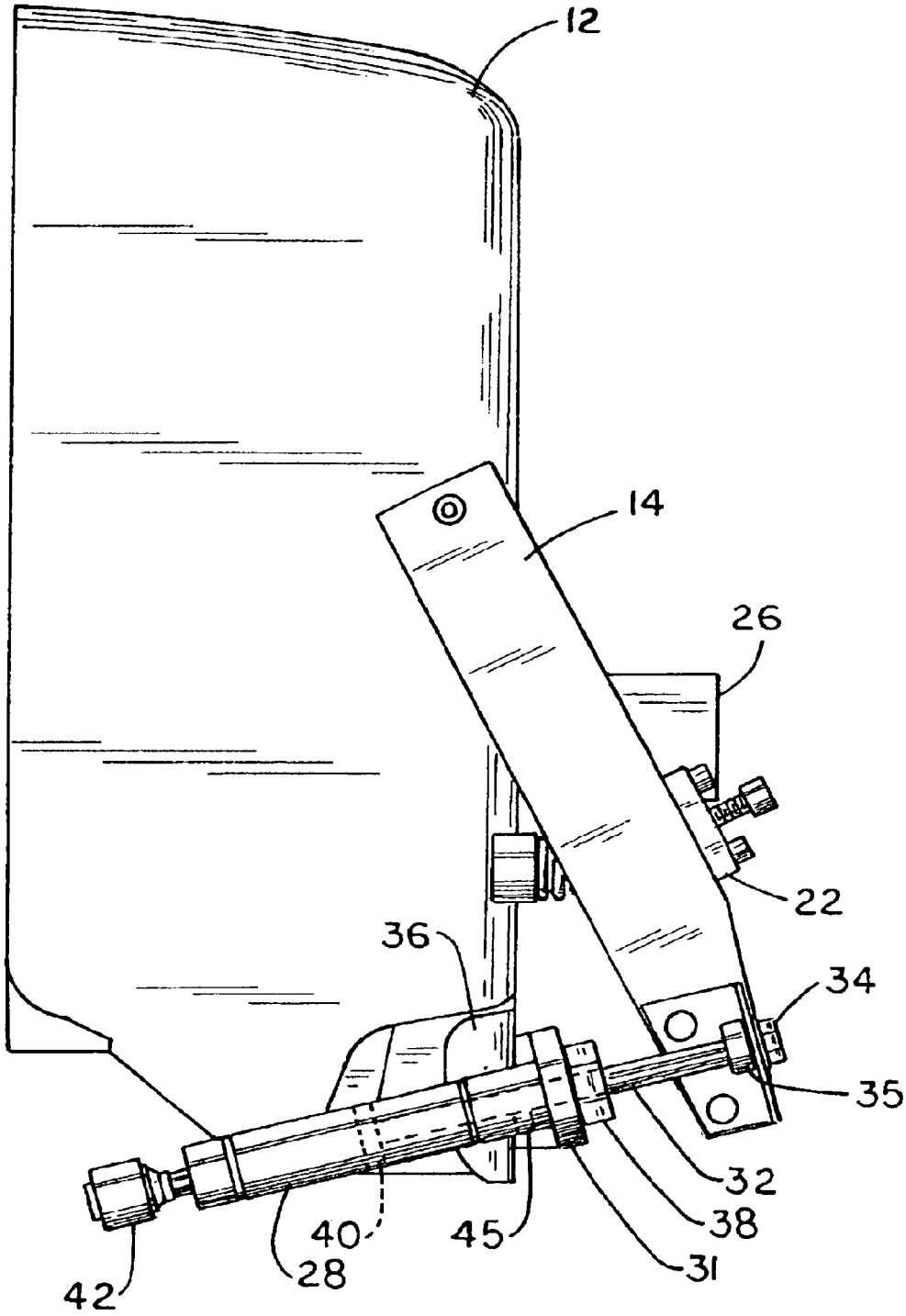
FIG. 2 is a side view thereof.
Figure 3:
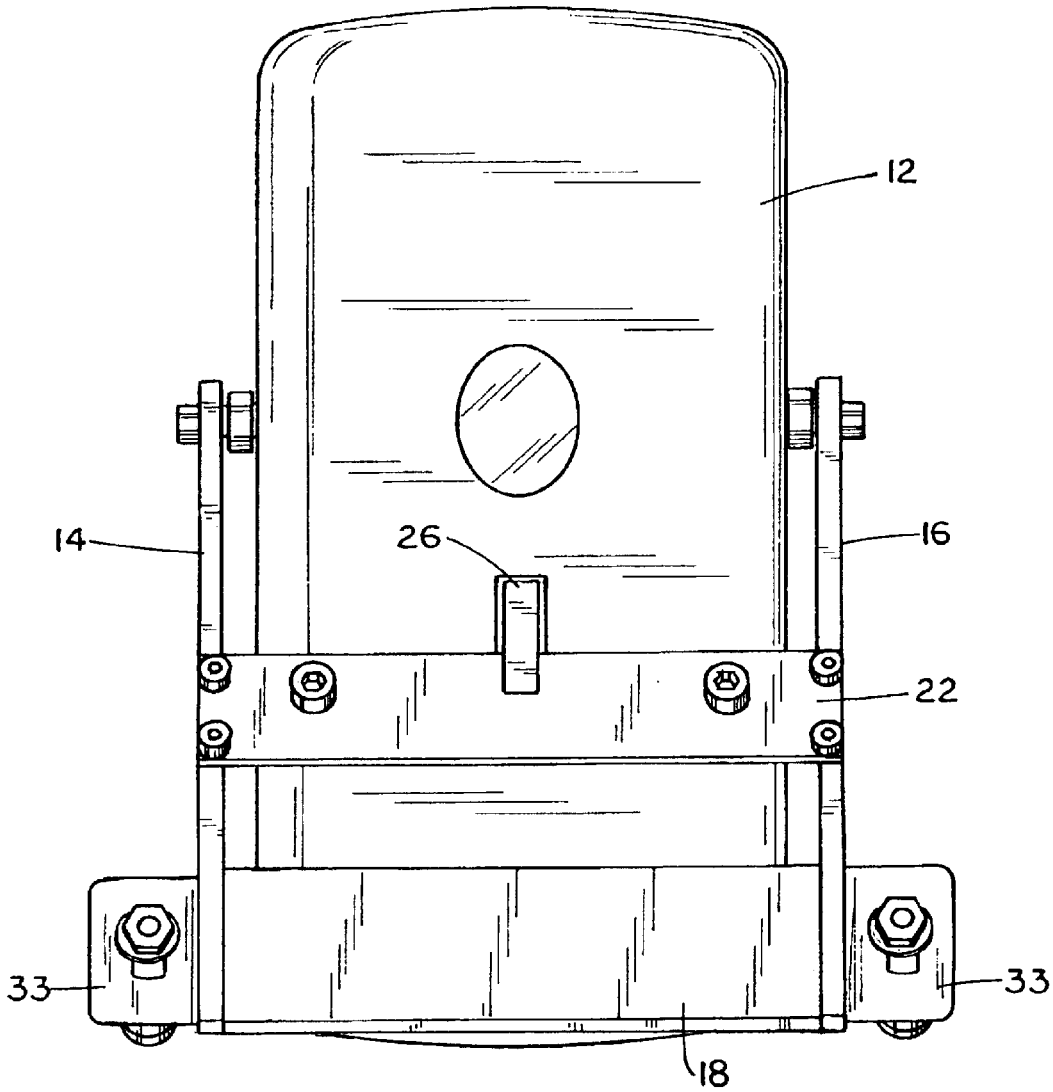
FIG. 3 is a front view thereof.
Figure 4:
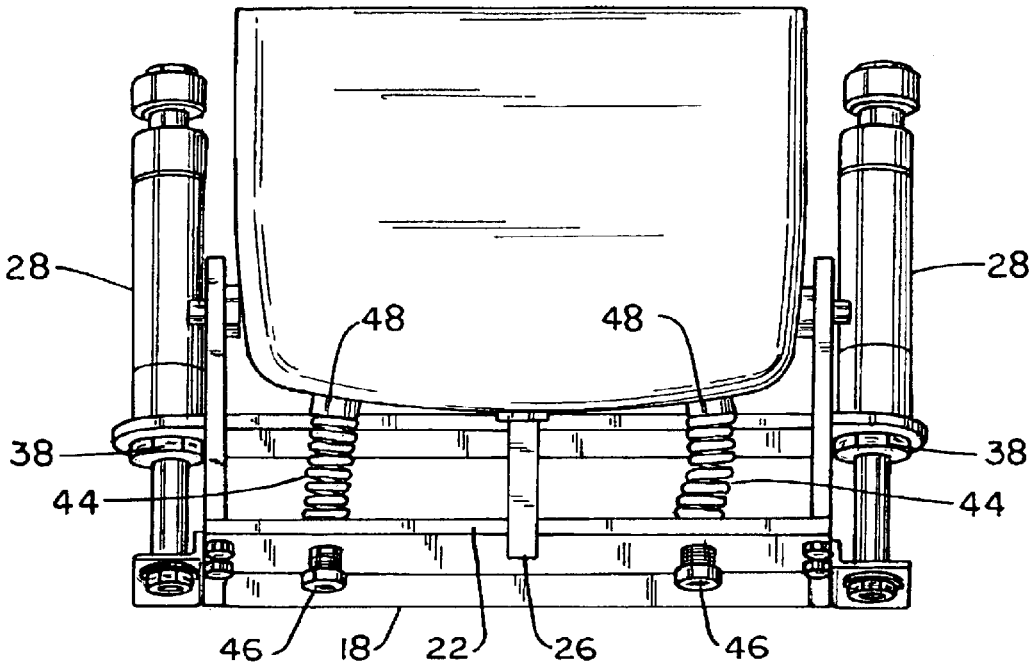
FIG. 4 is a top view thereof.
Figure 5:
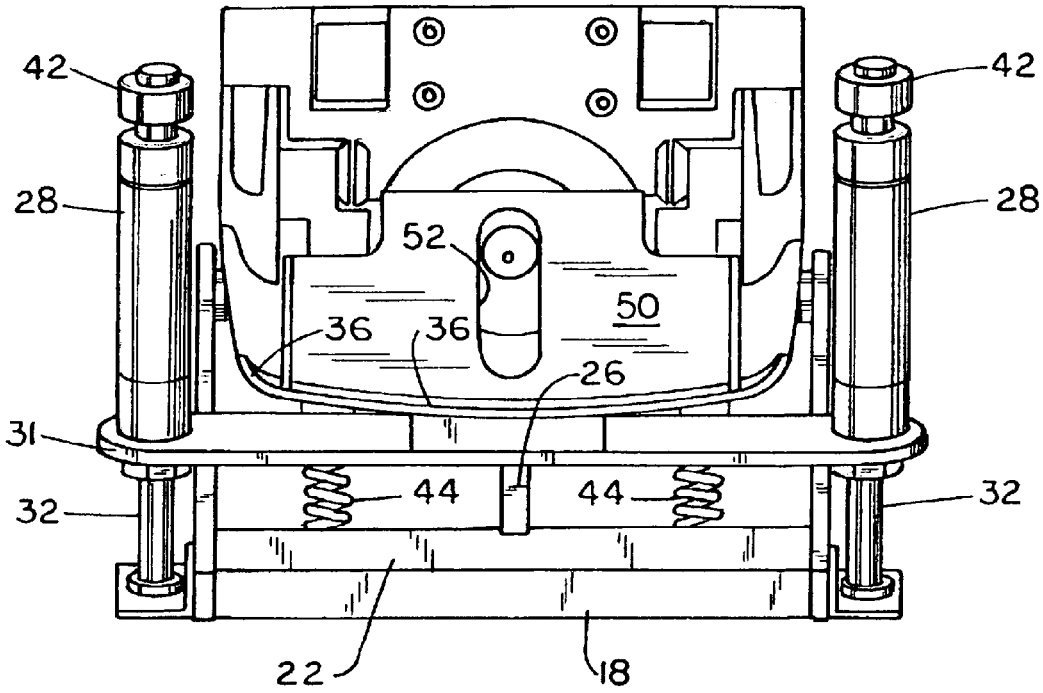
FIG. 5 is a bottom view thereof.
Figure 6:
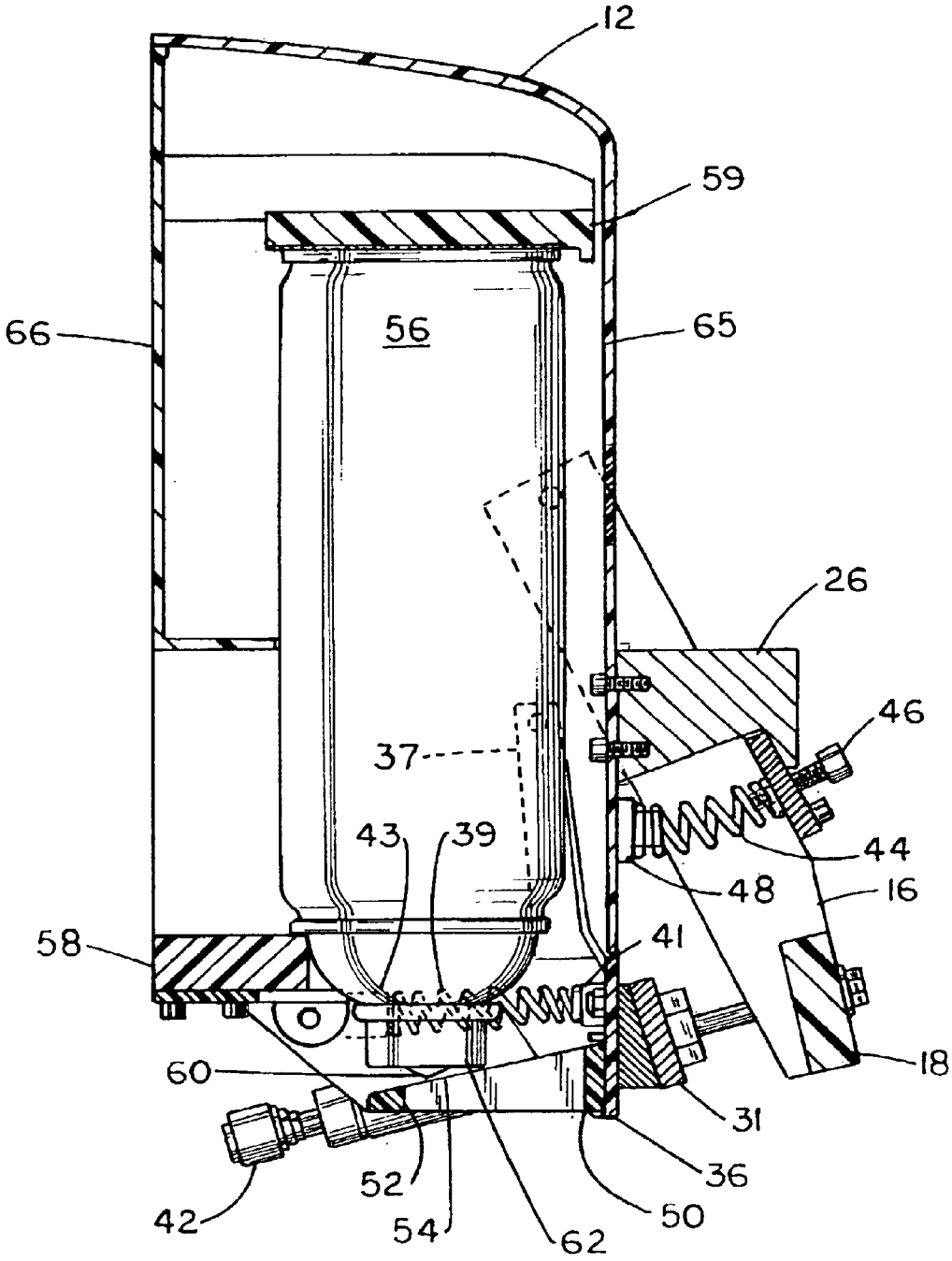
FIG. 6 is a vertical sectional view of the dispensing device indicating a first mode of operation.

A telescoping valve 80 has been described in conjunction with embodiment 10B. If desired, a one piece bellows could be substituted. It would also have the air regulator 42. As seen in FIGS. 1 and 4, the cylinders 28 and the arm members 14 and 16 are placed outside of housing 12. It is envisioned within the scope of this invention to have these components placed in a housing so that they would not be visible. The only visible component would be the bar member 18. The dispenser has been preferably described in conjunction with an aerosol container. It is obvious that it is not an essential feature and can be used in conjunction with a container that empties by gravity upon contact with a valve. All such another modification is within the spirit of the invention and is meant to be within scope as defined by the appended claims.

What is claimed is:

1. A self metering dispensing device for dispensing a predetermined quantity of material from a container having a nozzle comprising:

a housing defining a support for the container;

first and second actuating members pivotally connected to the housing;

a valve activating member connected to the first actuating member;

a fluid cylinder member having a reciprocating piston therein, the cylinder including a fluid regulator;

a reciprocating rod operatively connected to the piston, the cylinder member and the rod operatively associated with the first and second actuating members; and a first and second biasing member connected to the housing and the respective first and second actuating members.

2. The dispensing device as defined in claim 1 wherein there are two fluid cylinder members and rods with both cylinder members and the rods operatively associated with the first and second actuating members.

3. The dispensing device as defined in claim 1 wherein the cylinder member is connected to the first actuating member and the rod is connected to the second actuating member.

4. The dispensing device as defined in claim 1 wherein the housing is constructed and arranged to support the container in an inverted position.

5. The dispensing device as defined in claim 1 wherein the housing is constructed in two sections.

6. The dispensing device as defined in claim 5 wherein the first and second actuating members are connected to one of the two sections and the container is supported by the other section.

7. The dispensing device as defined in claim 1 wherein the valve activating member is defined by a solid block having a cammed surface opening for accommodating the nozzle.

8. The dispensing device as defined in claim 1 wherein the second actuating member includes a hand pressable bar member.

9. The dispensing device as defined in claim 8 wherein the second actuating member is pivotally connected to the housing by two oppositely disposed arm members.

10. The dispensing device as defined in claim 1 further including a stop member connected to the housing for control of the second actuating member.

11. The dispensing device as defined in claim 1 wherein the container is an aerosol container and contains a soap material.

12. The dispensing device as defined in claim 1 wherein the second biasing member is provided by a pair of spring members.

13. The dispensing device as defined in claim 1 wherein the fluid regulator is adjustable.

14. A self metering dispensing device for dispensing a predetermined quantity of material from a container having a nozzle comprising:

a housing defining a support for the container;

first and second actuating members pivotally connected to the housing;

a valve actuating member connected to the first actuating member;

a pneumatic member having a reciprocating piston therein, the pneumatic member including an air passage on one side of the piston and a fluid restrictor and check valve on another side;

a reciprocating rod operatively connected to the piston, the pneumatic member and the rod operatively associated with the first and second actuating members; and a first and second biasing member connected to the housing and the respective first and second actuating members.

15. A self metering dispensing device for dispensing a predetermined quantity of material from a container having a nozzle comprising:

a housing defining a support for the container;

a first actuating member pivotally connected to the housing;

a valve activating member connected to the first actuating member for contact with the nozzle;

a second actuating member pivotally connected to the housing;

a cylinder member connected to the second arm member, the cylinder member having a reciprocating piston therein, the cylinder including a fluid regulator valve;

a reciprocating rod operatively connected to the piston at one end, the rod also connected to the first actuating member at another end; and a first and second biasing member connected to the housing and the respective first and second actuating members.

16. The dispensing devices defined in claim 1 wherein the fluid regulator comprises an adjustable restrictor valve member.

17. A self metering dispensing device for dispensing a predetermined quantity of material from a container having a nozzle comprising:

a housing defining a support for the container; first and second actuating members pivotally connected to the housing;

a valve activating member connected to the first actuating member;

a fluid compressible and self expandable member positional between the first and second actuating members, the compressible member having an air regulator operatively associated therewith; and a first and second biasing member connected to the housing and the respective first and second actuating members, the first biasing member having a biasing force greater than a compressible force of the compressible member.

18. The dispensing device as defined in claim 17 wherein the first and second biasing member are spring members.

19. The dispensing device as defined in claim 17 wherein the fluid compressible and self expandable member is a valve with telescoping members.

20. The dispensing device as defined in claim 19 wherein the valve is positioned between two bar members comprising a portion of a nozzle actuating member.

21. A method of dispensing a material from a container employing the dispensing device defined in claim 1.

* * * * *